US005161474A

United States Patent [19]

Ishikawa et al.

[11] Patent Number: 5,161,474

[45] Date of Patent: Nov. 10, 1992

[54] METHOD OF SERGING TROUSER-FLY PIECE WITH SLIDE FASTENER STRINGER ATTACHED THERETO

[75] Inventors: Kiichiro Ishikawa; Chet Dudek, both of Marietta, Ga.

[73] Assignee: Yoshida Kogyo K.K., Tokyo, Japan

[21] Appl. No.: 761,444

[22] Filed: Sep. 18, 1991

[51] Int. Cl.[5] ..... D05B 37/00; D05B 27/00; D05B 35/10

[52] U.S. Cl. ..... 112/262.3; 112/122; 112/153; 112/265.2; 112/308

[58] Field of Search ..... 112/262.3, 265.2, 262.1, 112/104, 113, 153, 306, 121.27, 122, 129, 121.15, 308

[56] References Cited

U.S. PATENT DOCUMENTS

| | | | |
|---|---|---|---|
| 3,252,437 | 5/1966 | Pickett | 112/136 |
| 3,722,441 | 3/1973 | Kitchener et al. | 112/121.15 X |
| 3,919,942 | 11/1975 | Galya et al. | 112/197 X |
| 4,152,996 | 5/1979 | Van Amburg | 112/262.3 |
| 4,181,085 | 1/1980 | Conner, Jr. | 112/121.12 |
| 4,236,292 | 12/1980 | Orr et al. | 29/408 |
| 4,307,675 | 12/1981 | Off et al. | 112/153 X |
| 4,333,232 | 6/1982 | Orr et al. | 29/767 |
| 4,362,116 | 12/1982 | Sen Gupta et al. | 112/265.2 |
| 4,526,117 | 7/1985 | Willenbacher | 112/308 |
| 4,648,337 | 3/1987 | Mall | 112/153 |
| 4,722,290 | 2/1988 | Manuel et al. | 112/153 |
| 4,979,450 | 12/1990 | Dudek et al. | 112/265.2 |
| 5,069,148 | 12/1991 | Ishikawa | 112/104 |

FOREIGN PATENT DOCUMENTS

| | | |
|---|---|---|
| 3139426 | 2/1983 | Fed. Rep. of Germany . |
| 3314717 | 2/1984 | Fed. Rep. of Germany . |
| 3519344 | 4/1986 | Fed. Rep. of Germany . |
| 64-25898 | 1/1989 | Japan . |
| 1-101493 | 7/1989 | Japan . |
| 2062707 | 5/1981 | United Kingdom . |

OTHER PUBLICATIONS

Ishikawa et al. U.S. Ser. No. 578,669, filed Sep. 7, 1990 (pending).

*Primary Examiner*—Peter Nerbun

*Attorney, Agent, or Firm*—Hill, Van Santen, Steadman & Simpson

[57] ABSTRACT

An improved method of serging a trouser-fly piece on a serging machine having a trimming cutter is disclosed wherein a continuous trouser-fly blank assembly is fed intermittently into a first feed path extending toward the serging unit at a predetermined angle relative to a path of movement of the trouser-fly piece being advanced by the serging unit. Then the continuous trouser-fly blank assembly is cut into a succession of elongate rectangular trouser-fly pieces each of which is subsequently advanced toward the serging unit along the first feed path. Thereafter, at least a corner of a leading end of the trouser-fly piece is trimmed by the trimming cutter and, substantially at the same time, one curved longitudinal edge of the trouser-fly piece including the trimmed corner is serged with a serge stitching. In this instance, the trouser-fly piece is caused to turn in one direction to move from the first feed path to a second feed path extending parallel to and aligned with the path of movement of the trouser-fly piece being advanced by the serge unit. With this rotational movement of the trouser-fly piece, the trimming cutter accurately traces a substantially arcuate trimming line passing across the corner. The serged trouser-fly piece is automatically discharged from the serging unit.

6 Claims, 6 Drawing Sheets

METHOD OF SERGING TROUSER-FLY PIECE WITH SLIDE FASTENER STRINGER ATTACHED THERETO

BACKGROUND OF THE INVENTION

1. Field of the Invention

The present invention relates to an improvement in the production of serged trouser-fly pieces with slide fastener stringers attached thereto of the type wherein at least a corner of a leading end of the trouser-fly piece is trimmed along a substantially arcuate trimming line and, substantially at the same time, a serge stitching is formed on one longitudinal edge of the trouser-fly piece including the trimmed arcuate corner.

2. Description of the Related Art

A typical example of the serging process of the type concerned is described in U.S. Pat. No. 5,069,148 which has been assigned to the present assignee. According to the described serging process, an elongate rectangular trouser-fly piece attached to a slide fastener stringer chain of an individual fastener length is supplied to a serging machine having a trimming cutter. Subsequently, at least a corner of a leading end of the trouser-fly piece is trimmed by the trimming cutter along a substantially arcuate trimming line to form a curved longitudinal edge including the trimmed arcuate corner while the trouser-fly piece is being advanced by the serging machine. Substantially at the same time, the curved longitudinal edge of the trouser-fly piece including the trimmed arcuate corner is serged with a serge stitch to avoid raveling. The trouser-fly thus serged with the slide fastener stringer attached thereto can easily and neatly be attached to a trouser front with ornamental stitches, so called "J-stitches" because the curved longitudinal edge of the trouser-fly piece substantially conforms to a sewing line of the J-stitches. As against a conventional rectangular trouser-fly piece including a triangular flap portion extending outside the J-stitches, the trouser-fly piece having the arcuate corner neither makes the trouser front unsightly in appearance nor provides a sense of discomfort for the wearer of a pair of trousers.

However, due to the necessity of manually supplying the trouser-fly pieces of individual slide fastener lengths one by one to the serging machine, the foregoing serging process is relatively low in productivity and hence is not well suited for mass-production of trousers.

SUMMARY OF THE INVENTION

It is an object of the present invention to provide an improved serging method which is capable of producing a number of serged trouser-fly pieces automatically and successively from a continuous trouser-fly blank assembly and hence is well suited for the mass production of pairs of trousers.

Another object of this invention is to provide a serging method which is capable of producing serged trouser-fly pieces of different lengths.

According to the present invention, there is provided an improved method of trimming at least a corner of a leading end of an elongate rectangular trouser-fly piece along a substantially arcuate trimming line and substantially at the same time for forming a serge stitching on one longitudinal edge of the trouser-fly piece including the trimmed arcuate corner, wherein the improvement comprises: (a) feeding a continuous trouser-fly blank assembly intermittently into a first feed path extending at such an angle relative to a path of movement of the elongate rectangular trouser-fly piece being advanced by a serging unit including a trimming cutter that the trimming cutter assumes a position to conform to a curvature of the leading end of the substantially arcuate trimming line; (b) cutting the continuous trouser-fly blank assembly while at rest before a leading end of the trousers-fly blank assembly reaches the serging unit, thereby forming an elongate rectangular trouser-fly piece; (c) advancing the trouser-fly piece toward the serging unit longitudinally along the first feed path until a leading end of the trouser-fly piece arrives at a position immediately upstream of the trimming cutter; (d) operating the serging unit and the trimming cutter in synchronism with each other for trimming at least a corner of the leading end of the elongate rectangular trouser-fly piece and, substantially at the same time, for serging one curved longitudinal edge of the trouser-fly piece including the trimmed corner with the serge stitching while the trouser-fly piece is being advanced by the serging unit; (e) during the operation of the serging unit and the trimming cutter, causing the trouser-fly piece to automatically turn in one direction to move from the first feed path into a second feed path extending parallel to and aligned with the path of advancement of the trouser-fly piece by the serging unit, thereby enabling the trimming cutter to trim the corner of the leading end of the trouser-fly piece along the substantially arcuate trimming line to form the curved longitudinal edge including the trimmed arcuate corner while the trouser-fly piece is being advanced by the serging unit along the second feed path; and (f) discharging the thus-serged trouser-fly piece downstream of the serging unit.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

The present invention will be described hereinbelow in detail with reference to a preferred embodiment shown in the accompanying drawings.

Figure 1A:
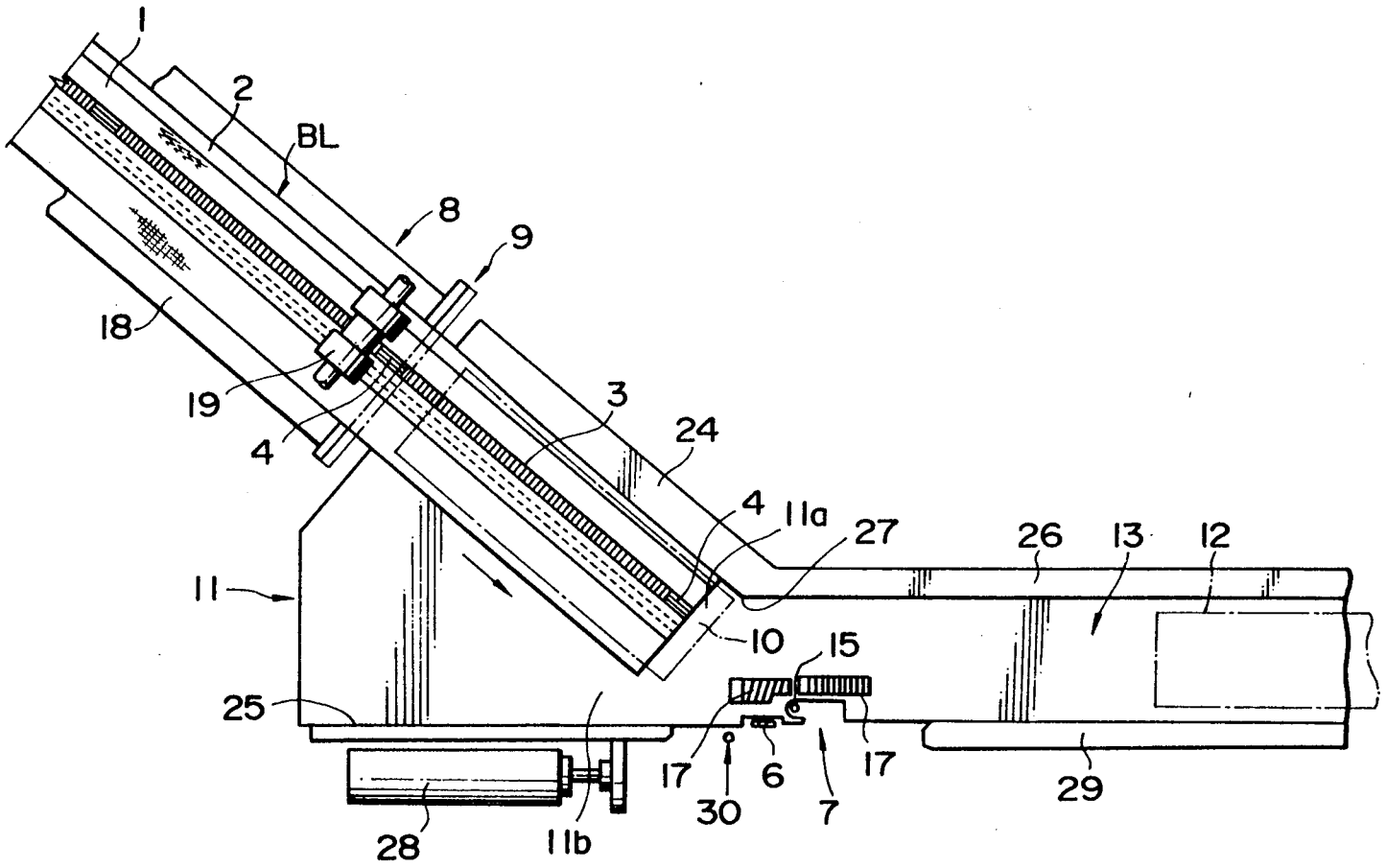
FIGS. 1(A) through 1(D) are schematic plan views illustrative of the manner in which a trouser-fly piece with a slide fastener stringer attached thereto is serged according to a method of the present invention.

FIG. 1(A) shows the general construction of a serging apparatus used for reducing a method of this invention into practice. In the illustrated embodiment, the serging apparatus is used with a continuous trouser-fly blank assembly BL composed of a continuous elongate trouser-fly fabric 2 and a continuous slide fastener stringer chain 1 attached by sewing to the trouser-fly fabric 2 along one longitudinal edge thereof. The slide fastener stringer chain 1 has a series of longitudinally spaced pairs of interengaged rows of coupling elements 3, there being space portions 4 devoid of coupling elements in the slide fastener stringer chain 1 at longitudinal intervals which are the same as a length of a trouser-fly piece 5 (FIG. 3) to be produced from the trouser-blank assembly BL by the serging apparatus.

Figure 1B:
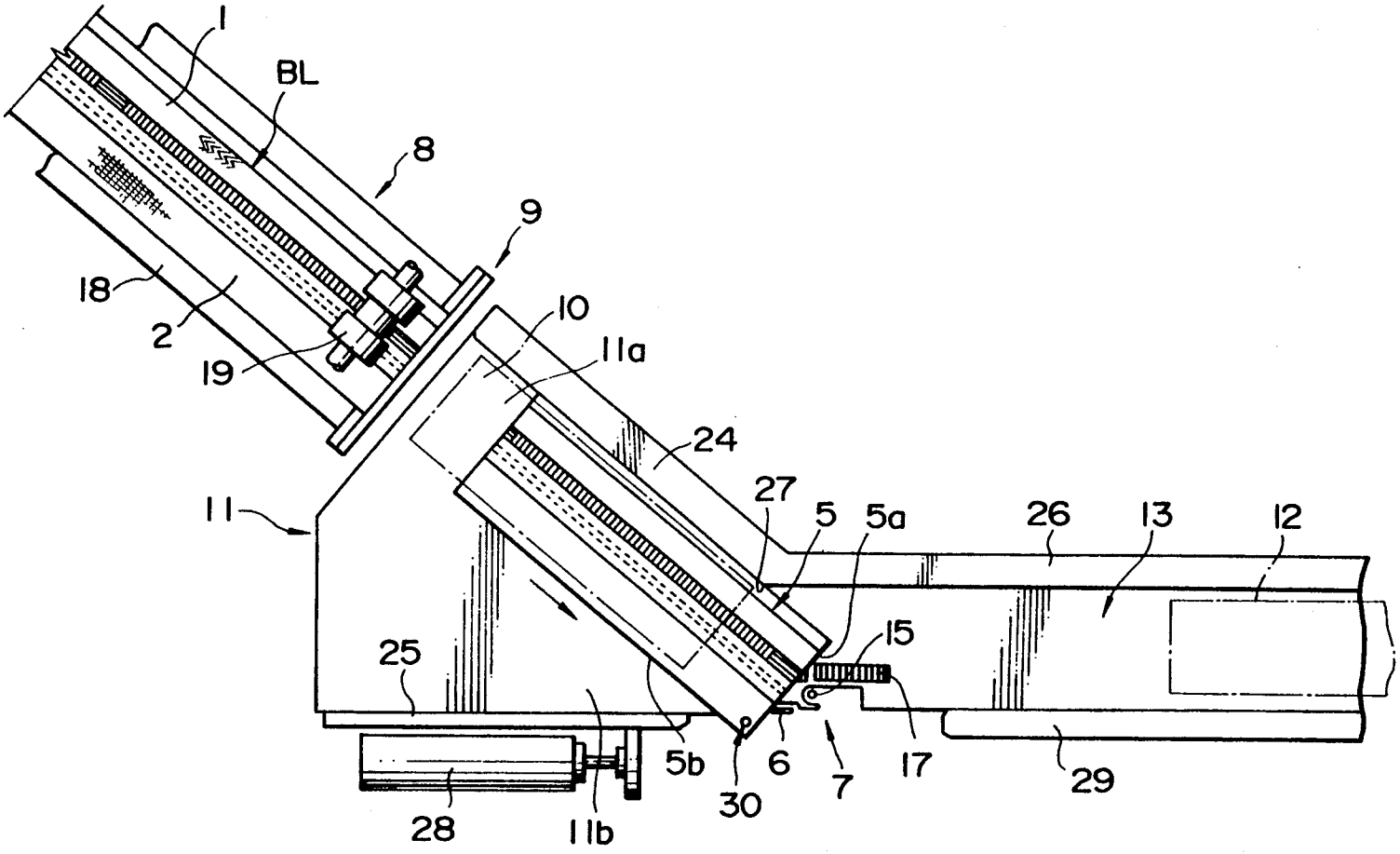

The serging apparatus generally comprises a serging unit 7 disposed substantially at the center of the serging apparatus and having a trimming cutter 6, a supply unit 8 disposed upstream of the serging unit 7 for supplying the continuous trouser-fly blank assembly BL toward the serging unit 7, a cutting unit 9 disposed between supply unit 8 and the serging unit 7 for cutting the continuous trouser-fly blank assembly BL along a cutting line C (FIG. 3) so as to form an elongate rectangular trouser-fly piece 5 (FIG. 1(B)) having a slide fastener stringer of an individual slide fastener length, a feed unit 10 disposed between the cutting unit 9 and the serging unit 7 for advancing the elongate rectangular trouser-fly piece 5 toward the serging unit 7 on and along an upper surface of a table 11, and a discharge unit 12 disposed downstream of the serging unit 7 for discharging the trouser-fly piece 5 along a discharge path 13 after the trouser-fly piece 5 is serged by the serging unit 7 along its one curved longitudinal edge.

Figure 1C:
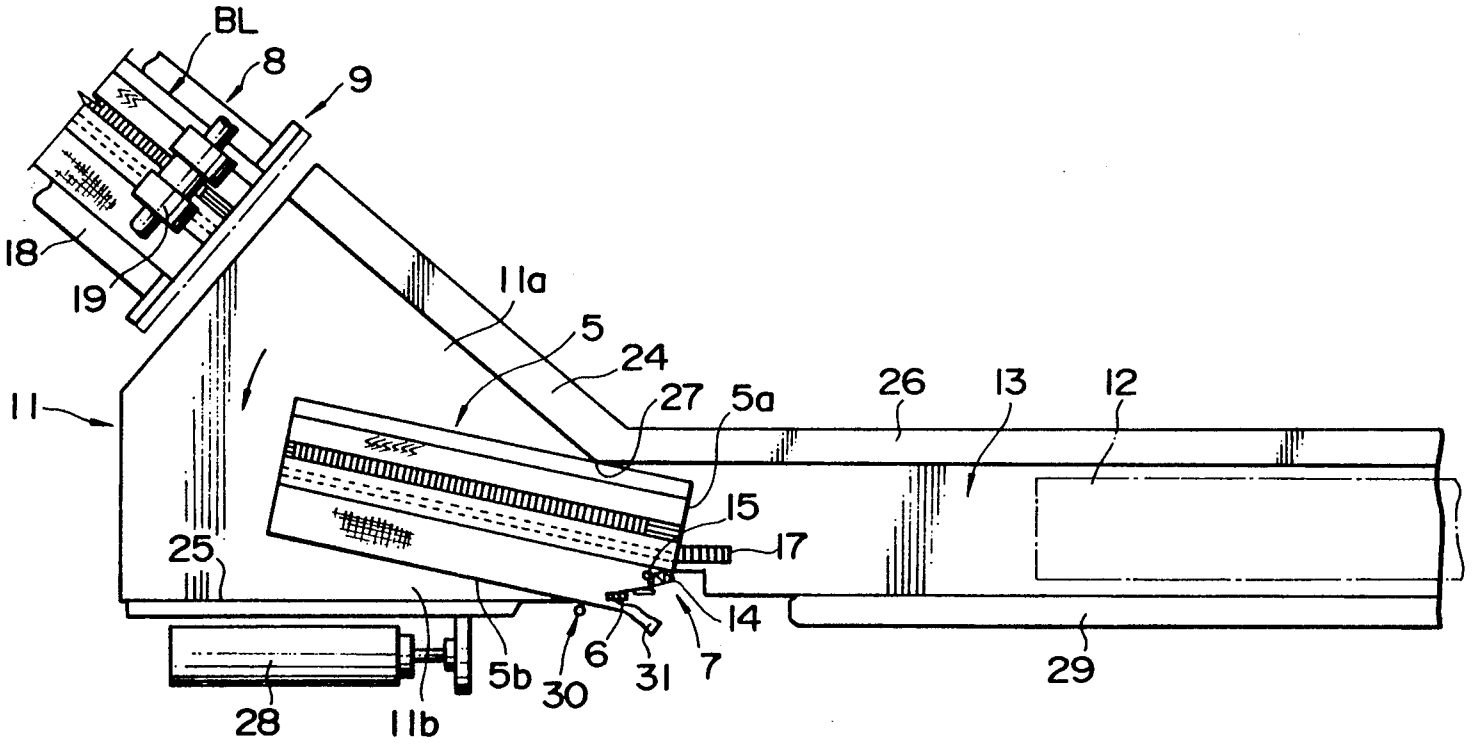
Figure 1D:
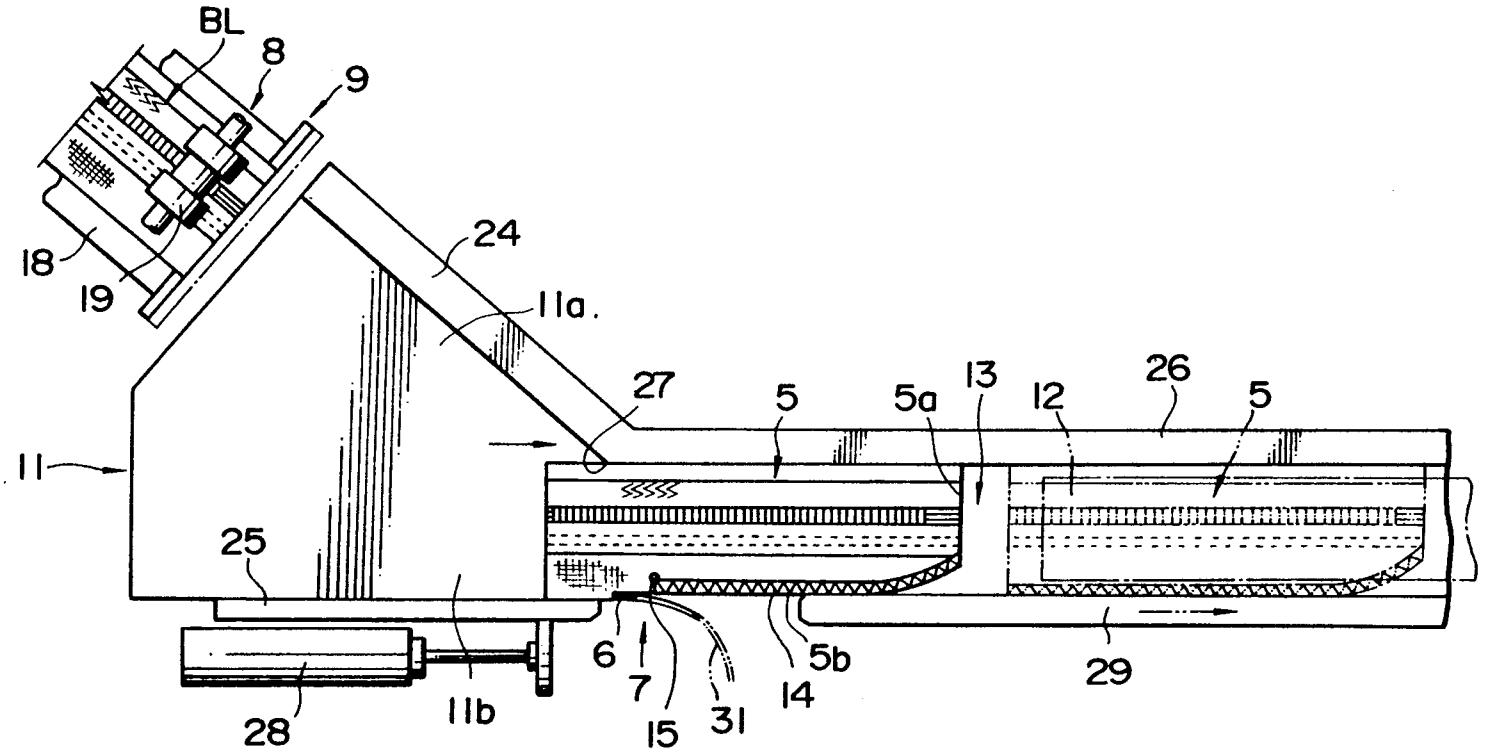
Figure 2:
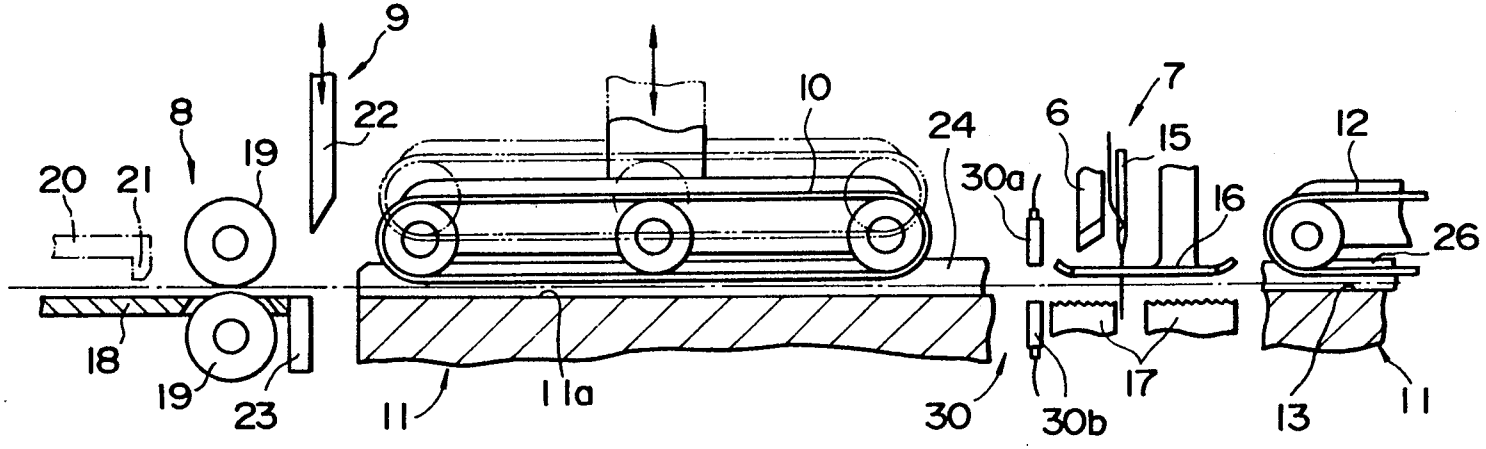
FIG. 2 is a diagrammatical front elevational view, with parts in cross section, of a main portion of a serging apparatus used for reducing the method into practice.
Figure 3:
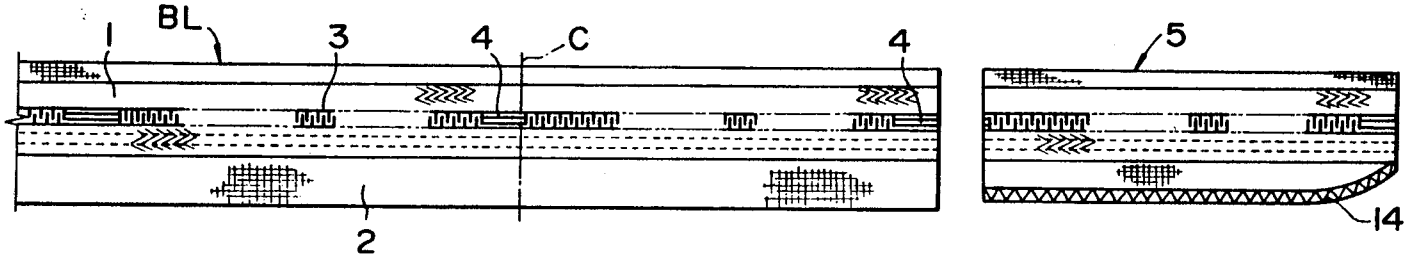
FIGS. 3, 4 and 5 are plan views showing various forms of a continuous trouser-fly blank assembly to be processed by the method of this invention and trouser-fly pieces produced from the corresponding trouser-fly piece blank assemblies.

The serging unit 7 is a conventional serging machine and includes a serge stitch forming mechanism having a needle 15 for forming an overedge or serge stitching 14 (FIGS. 1(D) and 3) on one longitudinal edge of a trouser-fly piece 5 to avoid raveling. The serging unit 7 further includes a plurality of feed dogs 17 disposed in the table 11 beneath the needle 15. The feed dogs 17 cooperate with a presser foot 16 (FIG. 2) to advance the trouser-fly piece 5 through a serging station in the serging unit 7 in timed relation to the operation of the serge stitch forming mechanism. Other component parts of the serge stitch forming mechanism are omitted for clarity. The trimming cutter 6 is disposed immediately upstream of the serging station for trimming at least a corner of the leading end 5*a* (FIGS. 1(B) and 1(C)) of the elongate rectangular trouser-fly piece 5 being advanced into the serging station. The trimming cutter 6 may be arranged to trim the elongate rectangular trouser-fly piece 5 along one longitudinal edge 5*b* including the trimmed corner, as shown in FIG. 1(D). The trimming cutter 6 is vertically reciprocated by a suitable drive means (not shown) in synchronism with the reciprocating movement of the needle 15 so that at least the corner of the leading end 5*a* of the elongate rectangular trouser-fly piece 5 is trimmed by the trimming cutter 6 and, substantially at the same time, the longitudinal edge 5*b* of the trouser-fly piece 5 including the trimmed corner is serged with the serge stitching 14 formed by the needle 15.

The supply unit 8 includes an elongate guide table 18 on and along which the continuous trouser-fly blank assembly BL is fed longitudinally toward the serging unit 7, and upper and lower feed rollers 19, 19 disposed at a downstream end of the guide table 18 and cooperative to feed the continuous trouser-fly blank assembly BL longitudinally. The elongate guide table 18 extends at such an angle relative to a path of movement of the trouser-fly piece 5 being advanced by the serging unit 7, for guiding the continuous trouser-fly blank assembly BL downstream into a first feed path 11*a* on the table 11 that the trimming cutter 6 assumes a position to conform to a curvature of the leading end of a substantially arcuate trimming line passing across a corner of the leading end 5*a* of an elongate rectangular trouser-fly piece 5 which has been severed from the continuous trouser-fly blank assembly BL. One of the feed rollers 19 is a drive roller and connected in driven relation to a drive means (not shown), while the other feed roller 19 is a presser roller normally urged against the drive roller and is provided with an encoder (not shown) for controlling the amount of feed of the continuous trouser-fly blank assembly BL. The drive roller 19 is driven to feed the trouser-fly blank assembly BL intermittently through a predetermined distance which is equal to the length of the trouser-fly piece 5. As shown in FIG. 2, a space sensor comprising a sensor lever 20 is disposed upstream of the feed rollers 19 for detecting the presence of the space portion 4 in the slide fastener stringer chain 1 (FIG. 3). The sensor lever 20 is urged clockwise in FIG. 2 so that a downwardly directed projection 21 of the sensor lever 20 moves into the space portion 4 when the space portion 4 arrives at a sensing position. When the space portion 4 is detected, the space sensor sends an electric signal to the encoder and the drive means (neither shown) of the feed rollers 19 so as to control the supply of the continuous trouser-fly blank assembly BL relative to the serging unit 7 in a manner known per se.

The cutting unit 9 for cutting the continuous trouser-fly blank assembly BL successively into a series of trouser-fly pieces 5 (FIG. 3) of individual slide fastener lengths is composed of a vertically movable upper cutting blade 22 and a stationary lower cutting blade 23. The upper cutting blade 22 is reciprocated by a suitable drive means (not shown) toward and away from the lower cutting blade 23 for cutting the continuous trouser-fly blank assembly BL transversely across the space portions 4 while the trouser-fly blank assembly BL is at rest. The cutting unit 9 is spaced from the serging unit 7 and the trimming cutter 6, in particular, at least by a distance greater then the length of the individual trouser-fly pieces 5.

The table 11 of the serging unit 7 supports not only a leading end portion of the continuous trouser-fly blank assembly BL before it is severed into an elongate rectangular trouser-fly piece 5, but also the trouser-fly piece 5 as it is advanced through the serging station. The table 11 has a same height as the elongate guide table 18 as shown in FIG. 2. Referring back to FIG. 1(A), the table 11 defines on its upper surface a first feed path 11*a* extending in longitudinal alignment with the elongate guide table 18 (i.e., the first feed path 11*a* extends at the same angle as the elongate guide table 18 relative to the path of movement of the trouser-fly piece 5 being advanced by the serging unit 7), and a second feed path 11*b* extending parallel to and aligned with the path of movement of the trouser-fly piece 5 being advanced through the serging station by the serging unit 7. The first and second feed paths 11*a*, 11*b* are disposed on an upstream side of the serging station and diverge toward the upstream side of the serging station. An upright first guide 24 is disposed on the upper surface of the table 11 and extends parallel to the first feed path 11*a* to define an outer side of the first feed path 11*a* for stable guidance of the elongate rectangular trouser-fly piece 5 into the serging station. Similarly, an upright second guide 25 is disposed on the super surface of the table 11 and extends parallel to the second feed path 11*b* to define an outer side of the second feed path 11*b* for stable guidance of the trouser-fly piece 5 toward the serging station. The first and second guides 24 and 25 guide the trouser-fly piece 5 as it is fed downstream along the first and second feed paths 11*a*, 11*b*, respectively. The first guide 24 as a downstream end disposed close to the serging station and integral with an upstream end of an upright third guide 26. The third guide 26 is disposed on the table 11 and extends parallel to the second guide 25 in a downstream direction of the serging station toward the discharge unit 12. The first and third guides 24, 26 extend at a predetermined angle relative to one another and jointly define a corner 27. The corner 27 serves as a fulcrum about which the trouser-fly piece 5 turns in a horizontal plane when it is being advance for the formation of the trimmed arcuate corner of the trouser-fly piece 5 as well as the formation of the serge stitching 14 on the trimmed arcuate corner, as described below in greater detail. The second guide 25 is reciprocally movably mounted on the table 11 and driven by a fluid-pressure actuator such as an air-cylinder 28 to move between an advanced position located close to the trimming cutter 6 and a retracted position spaced far distant from the trimming cutter 6 in an upstream direction of the trimming cutter 6. The second guide 25 is normally disposed in the retracted position for a reason described below.

As shown in FIG. 2, the feed unit 10 is disposed above the first feed path 11*a* and vertically movable toward and away from the upper surface of the table 11 for advancing the trouser-fly piece 5 along the first feed path 11*a*. The feed unit 10 is actuated by a suitable drive means such as a fluid-pressure actuator (not shown) to move an uppermost standby position vertically spaced from the table 11 and a lowermost operating position to feed the elongate rectangular trouser-fly piece 5. The feed unit 10 is normally disposed in the standby position for reasons described later. In the illustrated embodiment, the feed unit 10 includes an endless belt substantially coextensive with the first feed path 11*a*.

The discharge path 13 is defined on the upper surface of the table 11 at a downstream side of the serging station of the serging unit 7 and has a width substantially the same as or slightly larger than the width of a trouser-fly piece 5 which has been serged by the serging unit 7. An upright fourth guide 29 is disposed on the upper surface of the table 11 in opposed relation to the third guide 26 so as to define jointly with the third guide 26 the discharge path 13. With the third and fourth guides 26, 29 thus arranged, the trouser-fly piece 5 can be moved stably and reliably along the discharge path 13 without transverse displacement when it is being advanced by the discharge unit 12. The discharge unit 12, as shown in FIG. 2, is composed of an endless belt extending longitudinally along the discharge path 13 and held in friction engagement with the upper surface of the table 11 for positively forcing or discharging the serged trouser-fly piece 5 from the serging unit 7 into a subsequent processing station provided for the storage or the packing of the serged trouser-fly pieces 5 or the sewing of the serged trouser-fly piece 5 to the trouser front.

A photodetector 30 is disposed immediately upstream of the trimming cutter 6 on the outside of the table 11 for detecting the leading end 5*a* of the elongate rectangular trouser-fly piece 5. As shown in FIG. 2, the photodetector 30 is composed of a light source 30*a* disposed above the level of the table 11 and a photosensitive device 30*b* disposed below the level of the table in alignment with the light source 30*a*. When the leading end 5*a* of the trouser-fly piece 5*a* comes close to the serging station of the serging unit 7, a light path extending from the light source 30*a* to the photosensitive device 30*b* is blocked or interrupted by the trouser-fly piece 5*a*, as shown in FIG. 1(B) whereupon the photodetector 30 sends an electric signal to start operation of the serging unit 7 including and trimming cutter 6. In this instance, since a leading end portion of the elongate rectangular trouser-fly piece 5 partly projects laterally outwardly from the second feed path 11*b* due to the location of the photodetector 30 stated above, the second guide 25 must be retracted away from the serging station of the serging unit 7 to insure detection of the leading end 5*a* of the trouser-fly piece 5. For reliable guidance of the trouser-fly piece 5 toward the serging station, it is desired that the downstream end of the second guide 25 is disposed close to the serging station. To this end, the second guide 25 is reciprocated by the fluid-pressure actuator 28 between the retracted position shown in FIGS. 1(A)–1(C) and the advanced position shown in FIG. 1(D).

Operation of the serging apparatus of the foregoing construction will be described below with reference to FIGS. 1(A) through 1(D). In the initial state of the serging apparatus, the feed unit 10 is disposed in the uppermost stand-by position, the second guide 25 is disposed in the retracted position, the serging unit 7 including the trimming cutter 6 is deactivated, and the discharge unit 12 is also deactivated.

A trouser-fly blank assembly BL which is composed of a continuous elongate trouser-fly fabric 2 and a continuous slide fastener stringer chain 1 attached by sewing to the trouser-fly fabric 2 along one longitudinal edge thereof, is supplied by the supply unit 8 longitudinally into the first feed path 11*a* across a path of movement of the cutting unit 9, as shown in FIG. 1(A). The slide fastener stringer chain 1 has a space portion 4 at the leading end of the trouser-fly blank assembly BL. The advancing movement of the trouser-fly blank assembly BL causes the projection 21 of the sensor lever 20 to move into the succeeding space portion 4 whereupon the space portion 4 is detected. Upon detection of the space portion 4, the space sensor comprising the sensor lever 20 issues an electric signal to control the operation of the feed rollers 10 such that the forward movement of the trouser-fly blank assembly BL is continued until when a leading end of the succeeding space portion 4 is in registry with the path of movement of the cutting unit 9. Then, the cutting unit 9 is operated to sever the trouser-fly blank assembly BL (i.e., both the trouser-fly fabric 2 and the slide fastener stringer chain 1) along a cutting line C (FIG. 3) extending transversely across the succeeding space portion 4 while the trouser-fly blank assembly BL is at rest. Thus, an elongate rectangular trouser-fly piece 5 with a slide fastener stringer attached thereto is severed from the trouser-fly blank assembly BL. During the supply of the trouser-fly blank assembly BL, the feed unit 10 is held in its uppermost standby position upwardly spaced from the first feed path 11*a* with the result that the a leading end portion of the trouser-fly blank assembly BL can be supplied smoothly into the first feed path 11*a* and subsequently advanced downstream along the first feed path 11*a* while it is being guided by the first guide 24 along one longitudinal edge thereof.

After the cutting unit 9 cuts off the elongate rectangular trouser-fly piece 5 from the continuous trouser-fly blank assembly BL, the feed unit 10 composed of the endless belt is driven and lowered to the operating position whereby the elongate rectangular trouser-fly piece 5 is fed forwardly along the first feed path 11*a* until its leading end 5*a* reaches a position immediately upstream of the trimming cutter 6, as shown in FIG. 1(B). In this instance, the leading end 5*a* is detected by the photodetector 30 which in turn issues an electric signal to return the feed unit 10 to the uppermost stand-by position, lower the presser foot 16 of the serging unit 7, and start operation of the serging unit 7 including the trimming cutter 6. The elongate rectangular trouser-fly piece 5 guided by the first guide 24 extends longitudinally along the first feed path 11*a* which extends at a predetermined angle relative to the path of movement of the trouser-fly piece 5 being advanced by the serging unit 7. The angle of inclination is determined such that when the trouser-fly piece 5 is guided into a path of movement of the trimming cutter 6, the trimming cutter 6 assumes a position to conform to a curvature of the leading end of a substantially arcuate cutting line passing across a corner of the leading end 5*a* of the trouser-fly piece 5.

The feed dogs 17 cooperating with the presser foot 16 automatically advance the trouser-fly piece 5 toward the serging station. At the same time, the trimming cutter 6 vertically reciprocated to trim a corner of the leading end 5*a* of the trouser-fly piece 5 along the substantially arcuate trimming line. Also substantially at the same time, the needle 15 of the serging unit 7 is vertically reciprocated to form an overedge or serge stitching 14 on the trimmed substantially arcuate corner of the trouser-fly piece 5. A continuing advancing movement of the trouser-fly piece 5 by the serging unit 7 causes the trouser-fly piece 5 to turn about the corner 27 between the first and third guides 24, 26 in one direction (counterclockwise in FIG. 1(C)) so that the trouser-fly piece 5 angularly move from the first feed path 11*a* to the second feed path 11*b*, as shown in FIG. 1(C). With this angular movement of the trouser-fly piece 5, the trimming cutter 6 is able to cut the corner of the leading end of the trouser-fly piece 5 accurately along the predetermined arcuate trimming line and, substantially at the same time, the needle 15 forms the serge stitching 14 on and along the trimmed arcuate corner of the trouser-fly piece 5.

Thereafter, the fluid-pressure actuator 28 is activated to move the second guide 25 into the advanced position close to the trimming cutter 6, as shown in FIG. 1(D). The second guide 25 guides one curved longitudinal edge 5*b* of the trouser-fly piece 5 including the trimmed arcuate corner as the trouser-fly piece 5 is advanced by the serging unit 7 along the second feed path 11*b*. Continuing operation of the serging unit 7 causes the trouser-fly piece 5 to advance through the serging station with its curved longitudinal edges guided by the second guide 25. Thus, a portion of the curved longitudinal edge 5*b* which is contiguous to the trimmed arcuate corner is trimmed by the trimming cutter 6 and, substantially at the same time, the trimmed longitudinal edge 5*b* is serged with the serge stitching 14. During that time, an opposite straight longitudinal edge of the trouser-fly piece 5 is guided by the third guide 26, so that the trouser-fly piece 5 can be guided stably and reliably without transverse displacement. The serged longitudinal edge of the trouser-fly piece 5 is guided by the fourth guide 29. In the case where the trouser-fly piece 5 before being serged along its one longitudinal edge already has a finished width, this longitudinal edge is not subjected to trimming operation once a substantially arcuate trimmed corner is formed at the leading end of the trouser-fly piece 5. A serge stitching 14 is formed on and along the longitudinal edge including the trimmed arcuate corner. In FIGS. 1(C) and 1(D), the reference numeral 31 denotes a waste strip being cut off from the trouser-fly piece 5 during trimming operation.

When the serging of the curved longitudinal edge 5*b* completes, the discharge unit 12 is driven to feed a serged trouser-fly piece 5 downstream along the discharge path 13 until the serged trouser-fly piece 5 is discharged from the serging unit 7 to a subsequent processing station, not shown. During advancing movement along the discharge path 13, the serged trouser-fly piece 5 is stably and reliably guided by the third and fourth guides 26, 29 without transverse displacement.

One cycle of operation of the serging apparatus is thus completed and the foregoing cycle of operation is repeated until a desired number of serged trouser-fly pieces 5 are produced from the continuous trouser-fly blank assembly BL.

The serging method of this invention has various advantages, as follows. Since the supply unit 8, the cutting unit 9, the feed unit 10, the serging unit 7 including the trimming cutter 6, and the discharge unit 12 are interlocked one another to perform respective steps of operation in a controlled manner, a desired number of trouser-fly pieces 5 serged with one curved longitudinal edge including a trimmed arcuate corner can automatically and accurately be produced one by one from a continuous trouser-fly blank assembly BL including a continuous slide fastener stringer chain 1 attached to a continuous trouser-fly fabric 2 along the length thereof. The serging method of this invention provides a very high productivity and is hence well suited for the mass production of pairs of trousers. The elongate rectangular trouser-fly pieces 5 which have been severed from the continuous trouser-fly blank assembly BL are directly fed into a serging station, so that the serging operation can be performed efficiently and speedily. In the course of the serging operation, the trouser-fly pieces 5 automatically turn in one direction. This rotational movement of the trouser-fly piece 5 makes it possible to use a trouser-fly blank assembly supply unit 8 which is fixed in position relative to the serging unit 7. The serging apparatus for carrying out the present method is therefore simple in construction.

Figure 4:
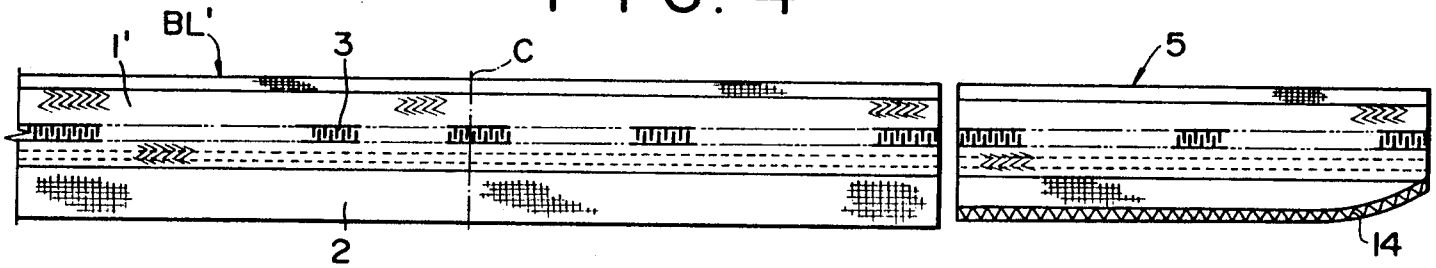

The serging method of this invention can effectively be carried out when used with a continuous trouser-fly blank assembly BL' shown in FIG. 4. The trouser-fly blank assembly BL' differs from the trouser-fly blank assembly BL shown in FIG. 3 in that the slide fastener stringer chain 1' has a pair of interengaged rows of coupling elements 3 and hence has no such element-free space portions 4 shown in FIG. 3. The trouser-fly blank assembly BL' is fed intermittently by the feed rollers 19 (FIG. 2) through a predetermined distance which is equal to a length of individual trouser-fly pieces 5. In this instance, the sensor lever 20 shown in FIG. 2 is no longer effective to measure the amount of feed of the trouser-fly blank assembly BL' due to the absence of the space portions in the slide fastener stringer chain 1'. The amount of feed of the trouser-fly blank assembly BL' is controlled by monitoring the amount of angular movement of one of the feed rollers 19. By using the trouser-fly blank assembly BL', the length of individual trouser-fly pieces 5 can be varied with the size of pairs of trousers to which the trouser-fly piece 5 are to be attached.

The reference character C denotes a cutting line along which the trouser-fly blank assembly BL' is severed.

Figure 5:
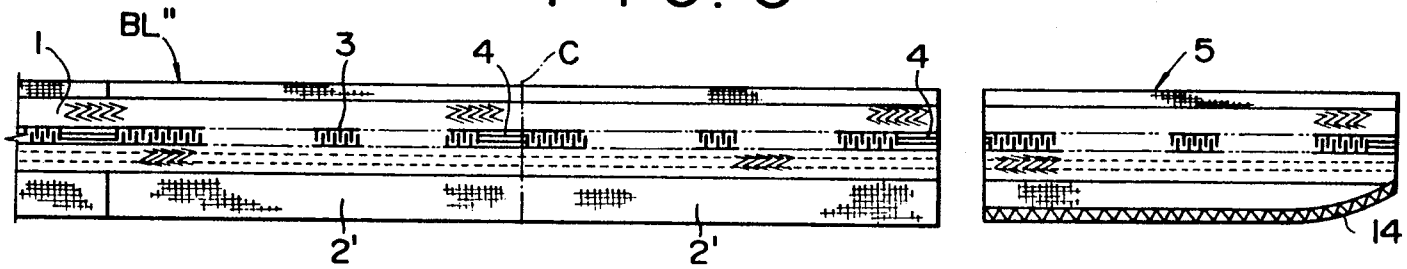

Another continuous trouser-fly blank assembly BL" shown in FIG. 5 can also be processed by the method of this invention. The trouser-fly blank assembly BL" differs from the trouser-fly blank assembly BL shown in FIG. 3 in that successive elongate rectangular trouser-fly fabrics 2' are attached by sewing to a continuous slide fastener stringer chain 1 in substantially end-to-end relation to one another. The elongate rectangular trouser-fly fabrics 2' have the same length as trouser-fly pieces 5 to be produced by the serging apparatus and they are separated from one another when the slide fastener stringer chain 1 is severed by the cutting unit 9 (FIG. 2) along a cutting line C.

Obviously, various modifications and variations of the present invention are possible in the light of the above teaching. It is therefore to be understood that within the scope of the appended claims the invention may be practiced otherwise than as specifically described.

What is claimed is:

1. An improved method of trimming at least a corner of a leading end of an elongate rectangular trouser-fly piece along a substantially arcuate trimming line and substantially at the same time for forming a serge stitching on one longitudinal edge of the trouser-fly piece including the trimmed arcuate corner, wherein the improvement comprises:

(a) automatically feeding a continuous trouser-fly blank assembly intermittently along a first feed path extending at an angle relative to a path of movement of the elongate rectangular trouser-fly piece being advanced by a serging unit including a trimming cutter such that the trimming cutter assumes a position to conform to a curvature of the leading end of said substantially arcuate trimming line;

(b) cutting the continuous trouser-fly blank assembly while at rest before a leading end of the trouser-fly blank assembly reaches the serging unit, thereby forming an elongate rectangular trouser-fly piece;

(c) automatically advancing the trouser-fly piece toward the serging unit longitudinally along said first feed path until a leading end of the trouser-fly piece arrives at a position immediately upstream of the trimming cutter;

(d) operating the serging unit and the trimming cutter in synchronism with each other for trimming at least a corner of the leading end of the elongate rectangular trouser-fly piece and, substantially at the same time, for serging one curved longitudinal edge of the trouser-fly piece including the trimmed corner with the serged stitching while the trouser-fly piece is being advanced by the serging unit;

(e) during the operation of the serging unit and the trimming cutter, causing the trouser-fly piece to automatically turn in one direction to move from said first feed path into a second feed path extending parallel to and aligned with said path of advancement of the trouser-fly piece by the serging unit, thereby enabling the trimming cutter to trim said corner of the leading end of the trouser-fly piece along the substantially arcuate trimming line to form the curved longitudinal edge including the trimmed arcuate corner while the trouser-fly piece is being advanced by said serging unit along said second feed path; and (f) discharging the thus-serged trouser-fly piece downstream of the serging unit.

2. The method as claimed in claim 1 wherein an opposite longitudinal edge of the elongate rectangular trouser-piece is guided as the trouser-fly piece is advanced along said first feed path, and said one curved longitudinal edge is guided as the trouser-fly piece is advanced along said second feed path.

3. The method as claimed in claim 1 wherein said one curved longitudinal edge and an opposite longitudinal edge of the trouser-fly piece are guided as the trouser-fly piece is discharged from the serging unit.

4. The method as claimed in claim 1 wherein the trouser-fly piece is caused to turn in said direction as it passes through a corner formed by and between a first guide extending parallel to said first feed path and a second guide integral with a downstream end of said first guide and extending parallel to said second feed path.

5. The method as claimed in claim 1 wherein said continuous trouser-fly blank assembly being fed is a continuous elongate trouser-fly fabric and a continuous slide fastener stringer chain attached to the trouser-fly fabric along one longitudinal edge thereof.

6. The method as claimed in claim 1 wherein said continuous trouser-fly blank assembly being fed is successive elongate rectangular trouser-fly fabrics attached longitudinally to a continuous slide fastener stringer chain in substantially end-to-end relation each of the trouser-fly fabrics having a same length as the trouser-fly piece.

* * * * *